United States Patent [19]

Rundell et al.

[11] 3,938,381

[45] Feb. 17, 1976

[54] SENSITIVE DEEP-WELL-DRILLING HOOK LOAD MEASURING SYSTEM

[75] Inventors: Herbert A. Rundell; Russell W. Hall, Jr., both of Houston, Tex.

[73] Assignee: Texaco Inc., New York, N.Y.

[22] Filed: Aug. 19, 1974

[21] Appl. No.: 498,332

[52] U.S. Cl. ..... 73/143; 177/210

[51] Int. Cl.[2] ..... G01L 5/10

[58] Field of Search ..... 73/141 R, 143; 177/164, 177/210

[56] References Cited

UNITED STATES PATENTS

| | | | |
|---|---|---|---|
| 2,803,799 | 8/1957 | Siegel et al. | 324/63 |
| 2,851,880 | 9/1958 | Fiedler | 73/141 R |
| 2,940,308 | 6/1960 | Calhoun | 73/143 |
| 3,469,645 | 9/1969 | Provi et al. | 177/164 X |

*Primary Examiner*—Charles A. Ruehl

*Attorney, Agent, or Firm*—T. H. Whaley; C. G. Ries; Henry C. Dearborn

[57] ABSTRACT

A hook load measuring system for improving the sensitivity of such measurements in deep-well-drilling operations. It employs a transducer actuated by the hook load and an output signal from the transducer that covers the full range of hook-load variation. There is an arrangement for nulling the signal at any given setting, and then for measuring change in a predetermined direction with greatly increased sensitivity.

2 Claims, 2 Drawing Figures

SENSITIVE DEEP-WELL-DRILLING HOOK LOAD MEASURING SYSTEM

BACKGROUND OF THE INVENTION

1. Field of the Invention

This invention concerns deep-well-drilling operations, in general, and more particularly relates to a system for improving the sensitivity of hook-load measurements.

2. Description of the Prior Art

In deep-well-drilling operations, in particular, it has been found that the load variations on the hook of the derrick are of such amplitude, in the total range thereof, as to make the measurements which are desired quite insensitive. For example, the conventional recording scale hook load measurement employs about 1,000 pounds per line of the cable pulley system per chart division. This results in 8,000 to 12,000 pounds per division of the chart scale. Consequently, small changes in weight on the hook are not visible in the resulting recording of such weight under the conventional measuring systems.

It is an object of this invention to provide an increase in the sensitivity of the system in order to be able to observe and/or record the changes in load that are relatively small compared to those previously possible.

SUMMARY OF THE INVENTION

Briefly, this invention concerns an improvement of a system that relates to a deep-well-drilling combination which employs a derrick having a crown block for supporting a sheave. The combination also employs a traveling block with pulley for supporting a hook to support a drill string and bit at the lower end thereof. The combination also employs a cable passing over said sheave and pulley. The said cable is anchored at one end by means of a weight transducer for measuring the hook load. In conjunction with the foregoing combination, the invention concerns the improvement which comprises (in combination) a potentiometer having a sliding contactor actuated by said transducer in proportion to said hook load. It also comprises means for applying an electromotive force to said potentiometer, and means for nulling the output signal from said sliding contactor at a predetermined hook load whereby the weight on the bit may be measured accurately.

Again, briefly, the invention concerns an improvement for a deep-well-drilling combination that employs a derrick having a crown block for supporting a sheave and a traveling block with pulley for supporting a hook to support a drill string with a bit at the lower end thereof. The combination also employs a cable passing over said sheave and pulley, the said cable is anchored at one end with a weight transducer for measuring the hook load. In conjunction with the foregoing combination, the invention concerns an improvement which comprises, in combination, a first potentiometer having a sliding contactor actuated by said transducer in proportion to said hook load, and a source of DC potential. The improvement combination also comprises a second potentiometer having a resistor connected across said potential source and having a sliding contactor, and a variable resistor connected in series with said second potentiometer sliding contactor. The improvement combination also comprises a galvanometer having an input circuit, a DC amplifier having an input and an output, as well as a fixed resistor connected in series with said variable resistor. The improvement combination also comprises first circuit means for connecting said DC amplifier input across said fixed resistor, second circuit means for connecting said DC amplifier output to said galvanometer input circuit, and a multipole multiposition switch. The improvement combination also comprises third circuit means for connecting said fixed resistor to one pole of said switch, fourth circuit means for connecting said first potentiometer sliding contactor to one position of said switch corresponding with said one pole, and a precision third potentiometer. The improvement combination also comprises a null meter, and fifth circuit means including said switch poles and positions for alternatively measuring said hook load or calibrating said second potentiometer or calibrating said first transducer-actuated potentiometer.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENT

Figure 1:
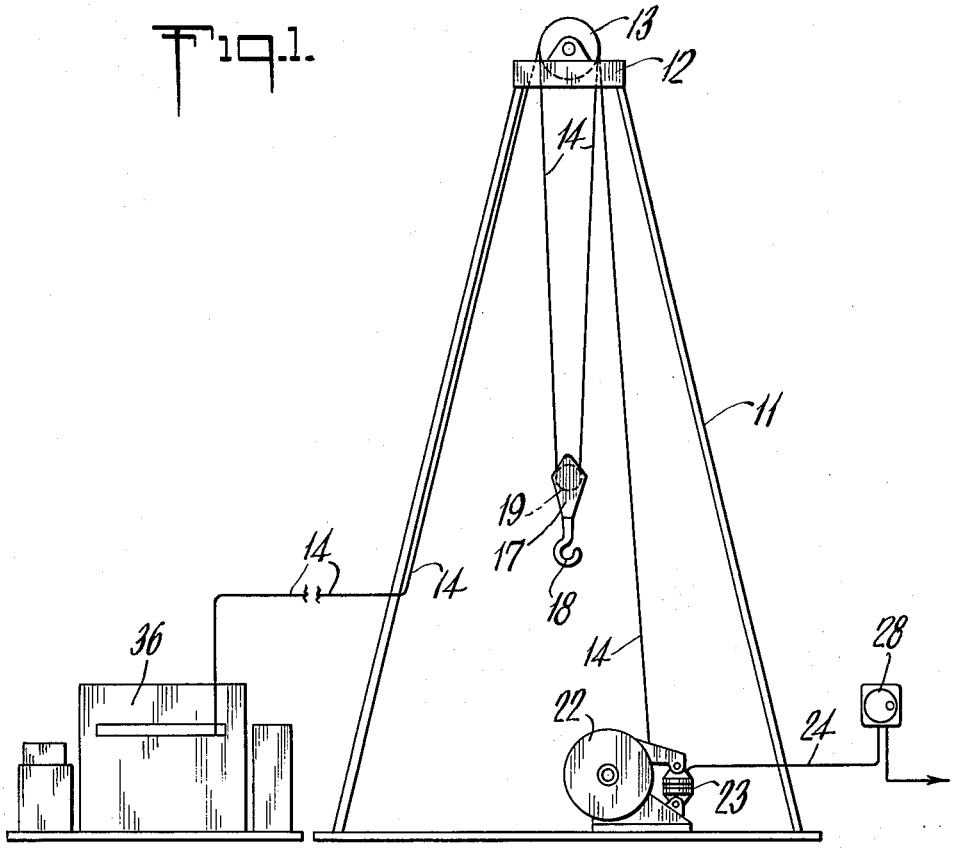
FIG. 1 is a schematic diagram illustrating a drilling rig including the elements that are employed with the invention.

FIG. 1 illustrates schematically the various elements that are employed in deep-well-drilling operations, and particularly those related to the measurement of load on the hook of the derrick. However, the drill string and bit have been omitted in order to improve the clarity of illustration.

Thus, there is illustrated a derrick 11 which has a crown block 12 at the top that supports a sheave 13 over which pass the strands of a drilling line or cable 14. Also, there is a traveling block 17 which supports a hook 18 and has a pulley 19 thereon that has strands of the cable 14 passing thereover. The cable 14 has an anchor 22 at the stationary end thereof. This anchor 22 incorporates a weight transducer 23. And, the transducer 23 may be like one which is part of a unit manufactured by the Martin-Decker Corporation of Santa Ana, Calif., and designated Type E National Wireline Anchor. The transducer 23 is called a "sensator" by the foregoing manufacturer. It transforms the force being applied to the anchor 22 by the "deadline" portion of the cable 14 into a hydraulic pressure that is carried over a hydraulic hose 24 to a signal transducer 28. This transducer 28 transforms the hydraulic pressure into a electrical signal by making use of a Bourdon tube 29 (see FIG. 2) that actuates a sliding contactor 32 of a potentiometer 33. Transducer 28 may be like one manufactured by Martin-Decker Corp. that has a normal range from 50 psi to 15,000 psi. However, for special applications it may be designed so as to extend the range to 20,000 psi.

The other end of the cable 14 is, of course, attached to a draw-works 36 that incorporates conventional drum and power drive (not shown) for winding and unwinding the cable 14, in the course of handling the drill string, (not shown) on the lower end of which is a drill bit (not shown).

As already indicated above, conventional arrangements provide for a measurement of the hook load or weight that are such as to result in chart scale units representing 8,000 to 12,000 pounds per scale division. In order to increase the sensitivity of such indication and/or recording of the weight or hook-load measurement, this invention employs a system that is substantially electrical.

Figure 2:
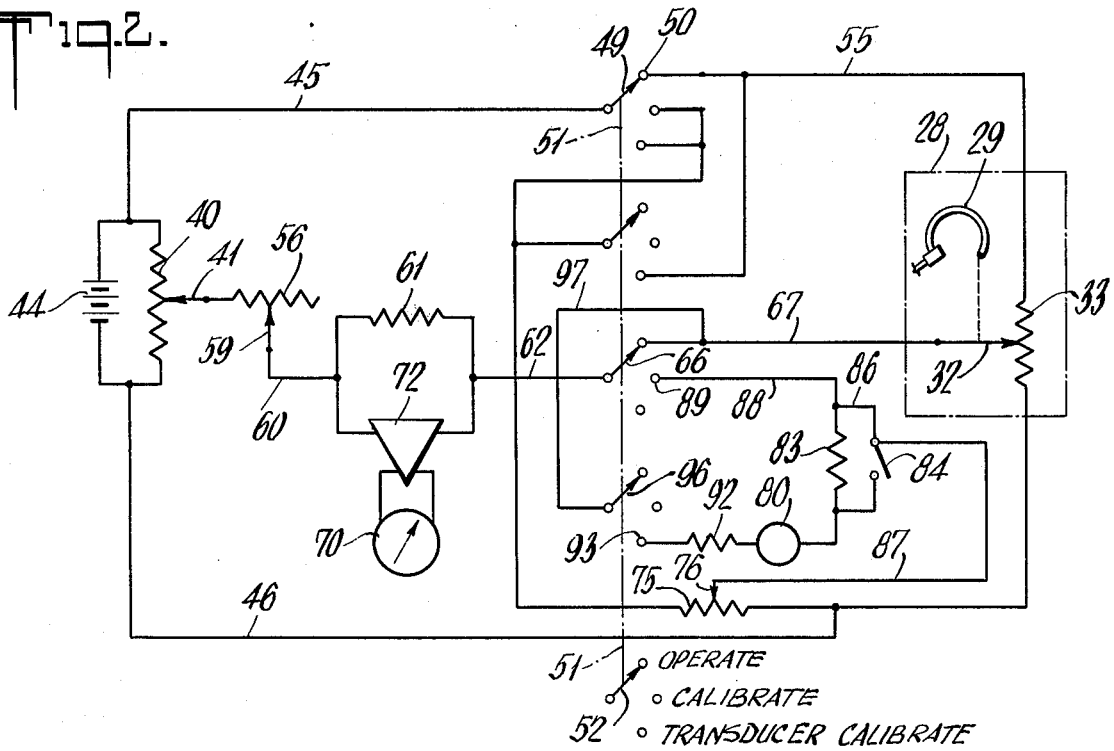
FIG. 2 is a circuit diagram illustrating the electrical elements and a circuit arrangement for the improved sensitivity system of this invention.

Thus, referring to FIG. 2, it will be observed that it has a second potentiometer 40 with a sliding contactor 41. The latter may be adjusted so as to be set in correspondence with any of the various positions that are assumed by the sliding contactor 32 of the transducer potentiometer 33.

The electrical system includes a DC power source 44 which might take various forms but preferably is a DC battery, as indicated. This battery 44 is connected across the potentiometer resistor 40, as indicated in FIG. 2. Also, it has parallel circuit connections over circuit wires 45 and 46 that connect with the ends of the potentiometer resistor 33.

It will be noted that the connection 45 goes to the upper end, as illustrated in FIG. 2, of potentiometer 33 via one pole 49 and a contact 50 of a multipole multiposition switch 51. This switch 51 has three positions which have the functions indicated by the captions opposite the unconnected contacts or positions opposite a lowermost pole 52 of the switch. Thus, in the position illustrated in FIG. 2, the system is connected for "operate" conditions, and the circuit connection 45 is continued via the pole 49 and the contact 50 over another circuit connection 55 to the upper end of the potentiometer 33.

In order to provide increased sensitivity, in accordance with this invention, for measuring relatively small load changes, there is connected to the sliding contactor 41 one end of the variable resistor 56. This resistor 56 has a variable contactor 59 which is connected via a circuit connection 60 to one end of a fixed resistor 61. The other end of resistor 61 is connected via a circuit connection 62 to a switch pole 66 that continues the circuit when the switch 51 is in the position that is illustrated. The circuit continues over a circuit connection 67 to the sliding contactor 32 of the potentiometer 33.

It will be observed that there is a galvanometer 70 which is connected across the ends of the fixed resistor 61 with an intervening amplifier 72. Consequently, the voltage drop across the fixed resistor 61 caused by current flow therethrough, may be measured and/or recorded, if desired, by means of the galvanometer 70. By choosing the type of amplifier 72 that is employed, the signals amplified may be only those developed when the voltage on the slider 41 is less than that on the transducer slider 32.

It will be observed that the system so far described provides for a means to accurately determine relatively small changes in the signal developed at the potentiometer 33. One aspect of this ability to see small changes in the weight being measured, is that of suppressing the lower portion of the signal. Thus, by means of adjusting the position of the sliding contactor 41 of the other potentiometer 40 until a null or zero current flow through the middle circuit which includes the resistor 61, is reached, a given hook load will be balanced out, or suppressed. Then, changes in the hook load or weight applied in a given direction may be measured with greatly increased sensitivity, with the range thereof determined by setting the variable resistor 56. Of course, the range depends upon the maximum reading available from the galvanometer 70 that is driven by the output of the amplifier 72.

Because the sensitivity of this system is great, it is necessary that the settings of variable resistor 56 (and its sliding contactor 59) as well as those of the sliding contactor 41 of the potentiometer 40 must be known exactly in relation to a predetermined indication of weight. This is accomplished by employing a calibration system which makes use of another potentiometer 75 that has a sliding contactor 76. This potentiometer 75 is a highly accurate multiturn-adjustment type of instrument with a precision dial so that its settings may be accurately related to particular weight indications.

The potentiometer 75 is connected to either of two calibration positions, one for calibrating the range settings described above, and the other for calibrating the transducer potentiometer 33. The former calibration may be made when the switch 51 is set to the middle or "calibrate" position so as to be able to match a given setting of the potentiometer 75 with the setting of the slider 41 of the potentiometer 40. In order to make such a match of these settings, there is a circuit that goes around a safety resistor 83 with a bypass switch 84 connected across it. This circuit connects the galvanometer 70 into a circuit between the contactor 76 and the contactor 41 via a circuit connection 87, a circuit connection 86 and a circuit connection 88 to a switch contact 89. Then this circuit is completed over the switch pole 66 to the series circuit described above, that goes to the sliding contactor 41.

It will be understood that the galvanometer 70 will indicate a zero reading when the slider 41 matches a given setting of the slider 76. Such position of the slider 41 will represent one end of a calibrated weight position, as indicated by the potentiometer 75. Then, after making a predetermined amount of adjustment of the slider 76, the galvanometer 70 may be set to a full scale reading by adjustment of the slider 59 on the resistor 56. This calibrates the maximum range of amplified changes in the weight or hook-load readings for that calibrated position of slider 41.

In order to make the other calibration, i.e. the weight readings of a given transducer 28 with its potentiometer 33, the switch 51 is set to the lowermost position which is designated by the caption "TRANSDUCER CALIBRATE". This connects a circuit which includes a null meter 80 and a resistor 92 which is in series therewith. These are connected between the sliding contactor 32 of potentiometer 33 and the sliding contactor 76 of precision potentiometer 75. That circuit may be traced from the slider 76 over the circuit connections 87 and 86 to the null meter 80, via resistor 83 with bypass switch 84. Then it continues through the resistor 92 to a switch contact 93 and via a pole 96 of the switch 51 to another circuit connection 97 which is connected into the connection 67 that leads to the sliding contactor 32.

It will be understood that with the system provided by this invention, it is feasible to increase the sensitivity of weight readings on a deep-well-drilling system by nulling most of the signals provided under given weight conditions and then reading the changes from that point in one direction for a given small or incremental portion of the total range. Furthermore, in order to keep such change readings accurate in extent and in terms of a weight reading for a particular force or load on the hook, use of a standard taken from the accurate precision potentiometer is important.

While a particular embodiment of the invention has been described in considerable detail in accordance with the applicable statutes, this is not to be taken as in any way limiting the invention but merely as being descriptive thereof.

What is claimed is:

1. In a deep-well-drilling combination employing a derrick having a crown block for supporting a sheave, a traveling block with pulley for supporting a hook to support a drill string and a bit at the lower end thereof, and a cable passing over said sheave and pulley, said cable being anchored at one end with a weight transducer for measuring the hook load, the improvement comprising in combination a potentiometer having a sliding contactor actuated by said transducer in proportion to said hook load, means for applying an electromotive force to said potentiometer, a second potentiometer connected to said electromotive force and having a sliding contactor, circuit means for connecting said sliding contactors to measure the difference in electric potential, said circuit means comprising a variable resistor, a meter for measuring said difference in potential, a fixed resistor, and amplifier means connected across said fixed resistor for amplifying the input to said meter, a precision third potentiometer, a null meter, and additional circuit means including switch means for calibrating said first and said second potentiometers.

2. In a deep-well-drilling combination employing a derrick having a crown block for supporting a sheave, a traveling block with pulley for supporting a hook to support a drill string with a bit at the lower end thereof, and a cable passing over said sheave and pulley, said cable being anchored at one end with a weight transducer for measuring the hook load, the improvement comprising in combination a first potentiometer having a sliding contactor actuated by said transducer in proportion to said hook load, a source of DC potential, a second potentiometer having a resistor connected across said potential source and having a sliding contactor, a variable resistor connected in series with said second potentiometer sliding contactor, a galvanometer having an input circuit, a DC amplifier having an input and an output, a fixed resistor connected in series with said variable resistor, first circuit means for connecting said DC amplifier input across said fixed resistor, second circuit means for connecting said DC amplifier output to said galvanometer input circuit, a multipole multiposition switch, third circuit means for connecting said fixed resistor to one pole of said switch, fourth circuit means for connecting said first potentiometer sliding contactor to one position of said switch corresponding with said one pole, a precision third potentiometer, a null meter, and fifth circuit means including said switch poles and positions for alternatively measuring said hook load or calibrating said second potentiometer or calibrating said first transducer-actuated potentiometer.

* * * * *